US011355298B2

(12) United States Patent
Enriquez et al.

(10) Patent No.: US 11,355,298 B2
(45) Date of Patent: Jun. 7, 2022

(54) METHOD OF MANUFACTURING AN OPEN-CAVITY FUSE USING A SACRIFICIAL MEMBER

(71) Applicant: Littelfuse, Inc., Chicago, IL (US)

(72) Inventors: Albert Enriquez, Lipa (PH); Victor Oliver Tabell, Mandaluyong (PH); Lily Rosios, Masbate (PH)

(73) Assignee: Littelfuse, Inc., Chicago, IL (US)

( * ) Notice: Subject to any disclaimer, the term of this patent is extended or adjusted under 35 U.S.C. 154(b) by 567 days.

(21) Appl. No.: 16/197,788

(22) Filed: Nov. 21, 2018

(65) Prior Publication Data

US 2020/0161068 A1 May 21, 2020

(51) Int. Cl.

*H01H 69/02* (2006.01)
*H01H 85/20* (2006.01)
*H01H 85/041* (2006.01)

(52) U.S. Cl.

CPC ..... *H01H 69/02* (2013.01); *H01H 85/041* (2013.01); *H01H 85/2045* (2013.01); *H01H 2229/016* (2013.01); *H01H 2229/056* (2013.01)

(58) Field of Classification Search

CPC ..... H01H 69/02; H01H 85/041; H01H 2229/056; H01H 85/2045; H01H 2229/016

USPC ..... 29/623

See application file for complete search history.

(56) References Cited

U.S. PATENT DOCUMENTS 4,862,134 A * 8/1989 Poerschke ..... H01H 69/02 337/231
2008/0191832 A1 8/2008 Tsai
2008/0218305 A1* 9/2008 Bender ..... H01H 85/0411 337/297
2010/0013045 A1 1/2010 Weeks
2016/0005561 A1* 1/2016 Enriquez ..... H01H 85/0411 337/297
2016/0379930 A1 12/2016 Jain et al.

FOREIGN PATENT DOCUMENTS

WO 2005086196 A1 9/2005

OTHER PUBLICATIONS

International Search Report and Written Opinion dated Feb. 6, 2020 for PCT Application, PCT/US2019/062477 filed Nov. 20, 2019.
Extended European Search Report dated Dec. 10, 2021 for corresponding EPO Application No. 19886997.6.

* cited by examiner

*Primary Examiner* — Jeffrey T Carley
(74) *Attorney, Agent, or Firm* — Kacvinsky Daisak Bluni PLLC

(57) ABSTRACT

A method of assembly of an open-cavity, wire-in-air fuse which provides improved manufacturing yield and fuse reliability, involving coiling, braiding or twisting a fusible element around a sacrificial member during the manufacturing process to provide support for the fusible element to prevent mechanical breakages and necking problems commonly encountered during manufacture.

23 Claims, 9 Drawing Sheets

A B

METHOD OF MANUFACTURING AN OPEN-CAVITY FUSE USING A SACRIFICIAL MEMBER

FIELD OF THE DISCLOSURE

The disclosure relates generally to the field of circuit protection devices and more particularly to a method of manufacturing a compact, laminated fuse.

BACKGROUND OF THE DISCLOSURE

In many circuit protection applications, it is desirable to employ fuses that are compact and that have high "breaking capacities." Breaking capacity (also commonly referred to as "interrupting capacity") is the current that a fuse is able to interrupt without being destroyed or causing an electric arc of unacceptable duration. Certain fuses are currently available that exhibit high breaking capacities and are suitable for compact applications, but such fuses are relatively expensive. It is therefore desirable to provide a low cost, high breaking capacity fuse that is suitable for compact circuit protection applications.

Fuses having an open cavity, for example, laminated fuses or split body fuses, are useful for purposes described in the previous paragraph, can be manufactured at a low cost and are suitable for compact circuit protection applications. It has been observed, however, that during the manufacturing process, damage to the fusible element wire may occur due to tensile stress induced from the threading process and the frailty of the fine wire used as the fusible element.

As an example, when manufacturing a laminated fuse, damage may occur due to the difference in coefficient of thermal expansion of the platinum core of the fusible element and the FR4 substrate when heat is applied during the lamination process. This damage may result in a mechanical fracture of the element wire, resulting in an open fuse as built or may result in a fuse having an element wire which exhibits severe necking in the middle, resulting in the fuse having a shortened life or which may be interrupted at a lower breaking capacity.

Therefore, it would be desirable to provide a process for manufacturing an open-cavity fuse which avoids the issues which may cause damage to the element wire.

SUMMARY OF THE INVENTION

This Summary is provided to introduce concepts related to the invention in a simplified form that are further described below in the Detailed Description. This Summary is not intended to identify key features or essential features of the claimed subject matter, nor is it intended as an aid in determining the scope of the claimed subject matter.

In accordance with the present disclosure, a method for manufacturing a compact, high breaking capacity fuse is provided. In various embodiments, the fuse may be of the laminated or split body type and will utilize a sacrificial member to support the fuse element during the manufacturing process.

An exemplary embodiment of a laminated fuse may include a top insulative layer, two or more intermediate insulative layers, and a bottom insulative layer arranged in a vertically stacked and bonded configuration, having epoxy layers therebetween. The at least two intermediate layers may have a hole formed therethrough that defines an air gap within the fuse. A first conductive terminal may be formed on a first end of the fuse and a second conductive terminal may be formed on a second end of the fuse. At least one fusible element may connect the first terminal to the second terminal, thus providing an electrically conductive pathway therebetween. A portion of the at least one fusible element may pass through the air gap defined by the holes in the at least two intermediate insulative layers.

During the manufacture of the fuse, the fusible element may be coiled, braided or twisted around a sacrificial member, which may be, for example, a soluble yarn, a length of plastic, a length of polymer or a length of sacrificial wire, to provide stability and support to the fusible element during manufacture. Further, coiling of the fusible element allows the stretching and contracting of the fusible element, making it less susceptible to damage caused by the difference in coefficients of thermal expansion of the element platinum core and the FR4 substrate during the lamination process.

For split body fuses, fuse elements may be supported during the manufacturing process by sacrificial member as previously described. In one embodiment, particularly applicable to higher capacity fuses having non-coiled fuse elements, the fuse element and the sacrificial member may be twisted around each other before being secured in terminals at either end, either by crimping or soldering. In another embodiment, particularly applicable to lower capacity fuses having coiled fuse elements, the fuse element may be coiled around the sacrificial member prior to securing in the terminals at either end. In either embodiment, the sacrificial member may be removed without damaging the fuse element prior to placing the cap on the split body fuse.

DETAILED DESCRIPTION

Figure 1:
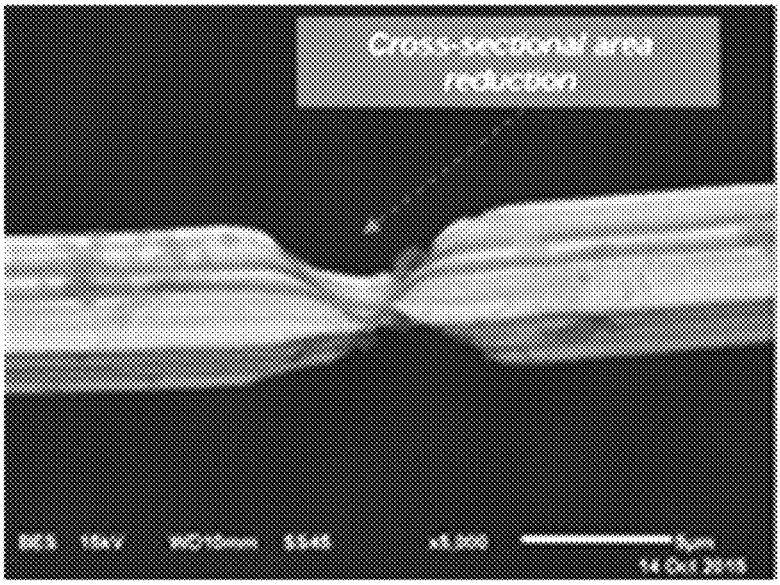
FIG. 1 illustrates of a fuse element with a "necking" problem prevalent when manufactured with the prior art manufacturing process.

The present invention will now be described more fully hereinafter with reference to the accompanying drawings, in which preferred embodiments of the invention are shown. This invention, however, may be embodied in many different forms and should not be construed as being limited to the embodiments set forth herein. Rather, these embodiments are provided so that this disclosure will be thorough and complete, and will fully convey the scope of the invention to those skilled in the art. In the drawings, like numbers refer to like elements throughout.

Generally, various embodiments of the invention involve supporting a fusible element with a sacrificial member during the manufacturing process of an open-cavity fuse to prevent damage to the fusible element. The sacrificial member may be, for example, soluble yarn, plastic, polymer, or a metal. The fusible element may be twisted, braided or coiled about the sacrificial member. The sacrificial member is then removed by dissolving, etching or ablating the sacrificial member prior to sealing of the open cavity.

Figure 2:
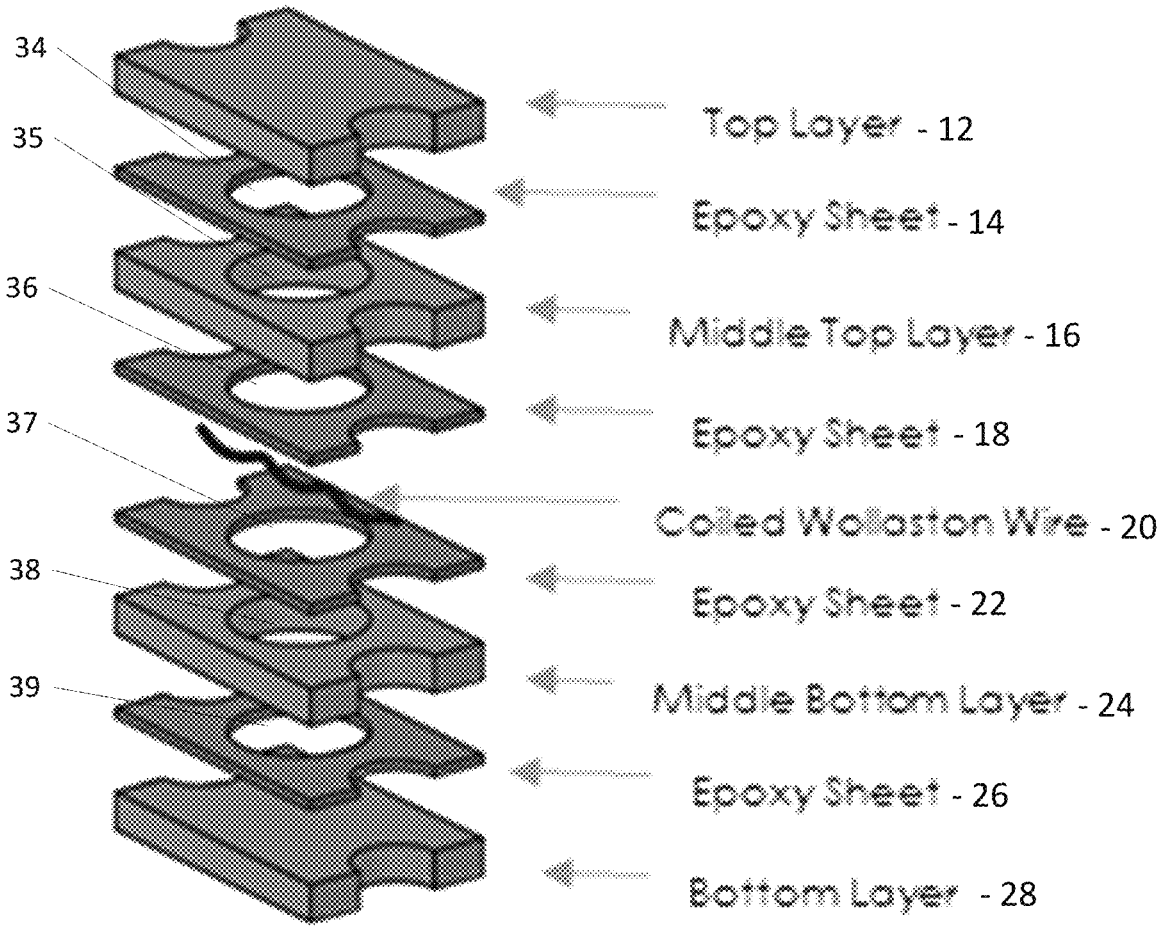
FIG. 2 shows an exploded view illustrating a high breaking capacity fuse manufactured in accordance with exemplary embodiments of the present disclosure.
Figure 3:
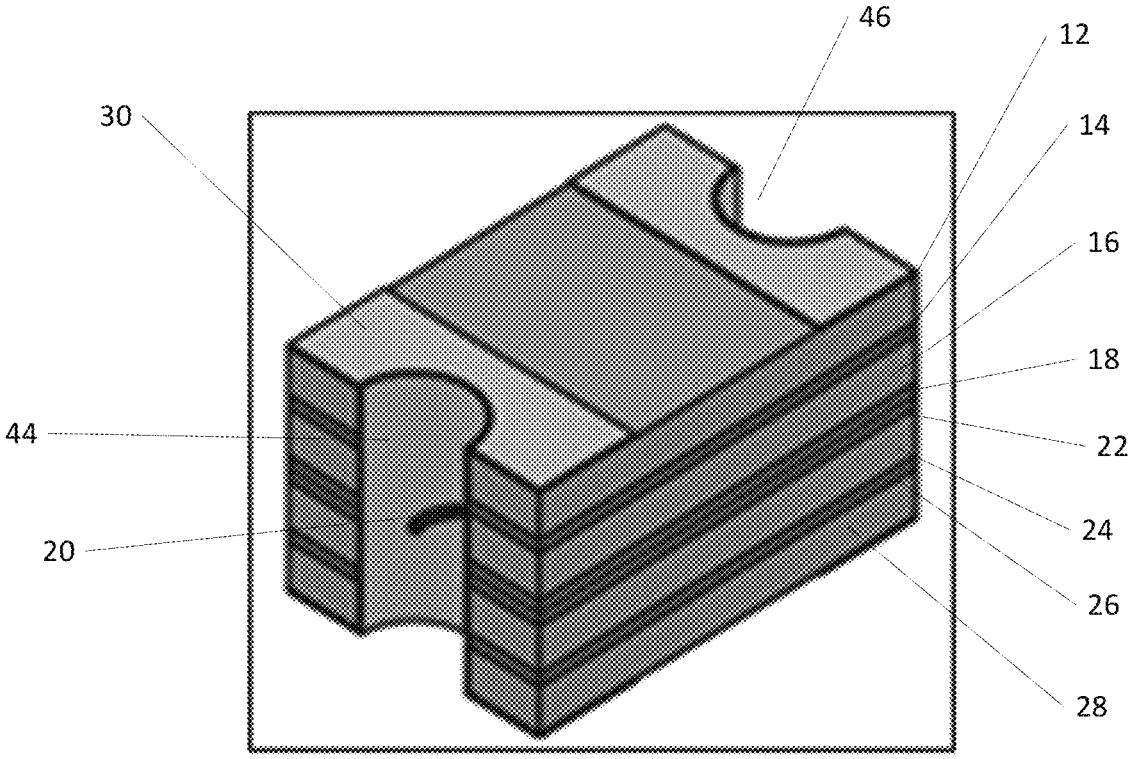
FIG. 3 is a perspective view illustrating the high breaking capacity fuse of FIG. 2 in assembled form.

Referring to FIGS. 2 and 3, a first exemplary embodiment of a high breaking capacity laminated fuse 10 manufactured in accordance with the present disclosure is shown. Fuse 10 is shown exploded in FIG. 2 and in a fully assembled configuration in FIG. 3. In one embodiment, fuse 10 may include a top insulative layer 12, a middle top insulative layer 16, a middle bottom insulative layer 24, and a bottom insulative layer 28, laminated together in a vertically stacked configuration. Insulative layers 12, 16, 24 and 28, in one embodiment, are substantially rectangular and may be formed of any suitable, electrically insulative material, including, but not limited to, FR-4, glass, ceramic, plastic, etc. Insulative layers 12, 16, 24 and 28 may be laminated, using an epoxy between the layers of the lamination, the epoxy preferably being in the form of epoxy sheets 14, 18, 22 and 28. The fusible element 20 is preferably disposed between the middle top insulative layer 16 and middle bottom insulative layer 24.

When assembled as shown in FIG. 3, the layers 12, 14, 24 and 28 may be flatly bonded to each other, such as with epoxy, pre-preg, or with other non-conductive adhesives or fasteners. Generally, the lamination process involves pressing one insulative layer to an adjacent insulative layer, having a thermosetting epoxy therebetween, and heating the assembly to polymerize the epoxy. The insulative layers 12, 14, 24 and 28 and epoxy layers 14, 18, 22 and 26 of the fuse 10 may have castellations 44, 46 at their opposite longitudinal ends, such as may be formed by drilling, for providing the assembled fuse 10 with terminals 30 and 32, as shown in FIG. 3. The longitudinal ends of the layers and castellated areas 44 and 46 may be plated with copper or other electrically conductive materials, such as by a photolithography process or other plating means, to facilitate electrical connection between the terminals 30 and 32 of the assembled fuse and other circuit elements.

Figure 8:
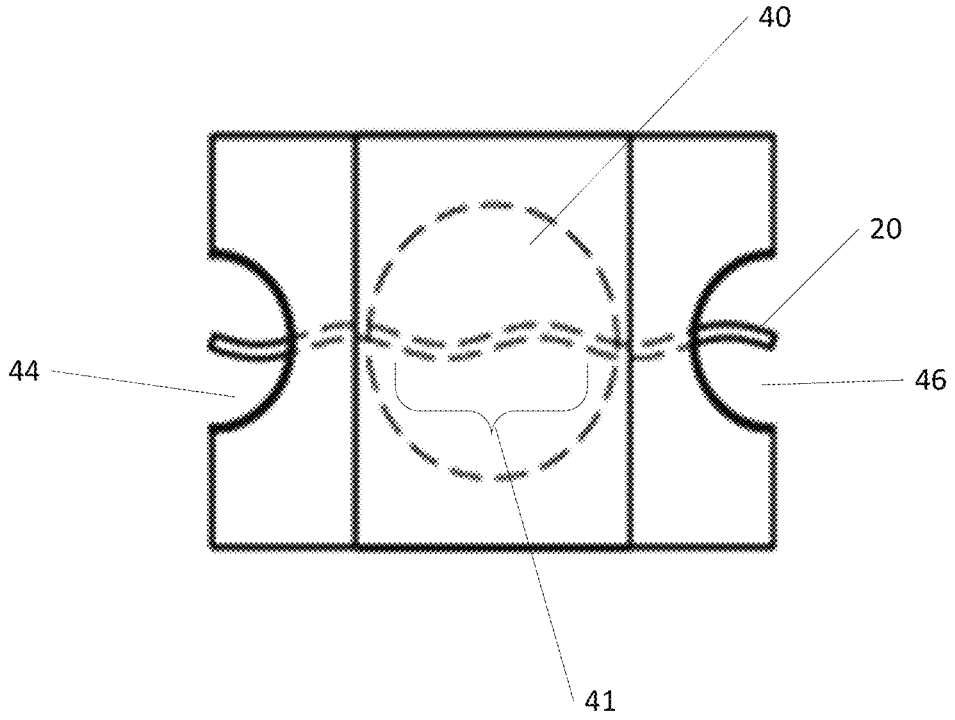
FIG. 8 is a drawing of a top view of the fuse showing the desired orientation of the fuse element after assembly.

As shown in the exploded view of FIG. 2, middle top insulative layer 16 and middle bottom insulative layer 24 may each be provided with a through-hole 35 and 38 respectively, formed in a center portion thereof, that defines an open cavity 40, which may be seen in each layer of the exploded view shown in FIG. 2 and in the top view of the assembled fuse shown in FIG. 8, in the assembled fuse 10. Holes 34 and 36 are shown having a circular shape, but it is contemplated that through-holes 35 and 38 may be formed having a variety of other shapes, such as oval, rectangular, triangular, or irregular. Top insulative layer 12 and bottom insulative layer 28 are identical to middle layers 16 and 24, with the exception of that top and bottom layers 12 and 28 are not provided with a through-hole, such that top and bottom 12 and 28 provide a seal to open cavity 40 in the assembled fuse 10. In a preferred embodiment, all insulative layers 12, 16, 24 and 28 will be of the same thickness. Alternatively, top and bottom layers 12 and 28 may be the same thickness, while middle layers 16 and 24 may be the same thickness, which may differ from the thickness of top and bottom layers 12 and 28, but this is not critical. It is contemplated that that middle layers 16 and 24 may alternatively be thinner or thicker than top and bottom layers 12 and 28.

Epoxy sheets 14, 18, 22 and 26 may also be provided with through-holes 34, 36, 37 and 39 respectively, which align with and are the same shape as through-holes 35 and 38 disposed in middle top layer 16 and middle bottom layer 24 respectively. Epoxy sheet may also be provided with castellated ends matching the castellated ends of insulative layers 12, 16, 24 and 28.

The fuse 10 may include a fusible element 20 disposed intermediate middle top insulative layer 16 and middle bottom insulative layer 24, and arranged such that a portion of fusible element 20 passes through open cavity 40 formed by through-holes 34-39 in the various layers. Additionally, opposite ends of fusible element 20 may extend outwardly into the castellations 44, 46 formed at the ends of each layer to facilitate electrical connection with terminals 30 and 32 of the assembled fuse. The fusible element 20 thereby provides an electrically conductive pathway between the terminals 30 and 32.

The middle portion 41 of fusible element 20 is a "weak point" that will predictably separate upon the occurrence of an overcurrent condition in fuse 10. Because the middle portion 41 is entirely surrounded by air and is not in contact with, or in close proximity to, the insulative material that forms the layers 12, 16, 24 and 28, an electric arc that forms in the middle portion 40 during an overcurrent condition is deprived of fuel (i.e. surrounding material) that might otherwise sustain the arc. Arc time is thereby reduced, which, in turn, increases the breaking capacity of the fuse 10.

The fusible element 20 may be formed of any suitable, electrically conductive material, such as nickel or platinum, and may be formed as a braided wire, a ribbon, a spiral wound or coiled wire, or any other suitable structure or configuration for providing a slack on the element to form a stress relief. As will be appreciated by those of ordinary skill in the art, the particular size, configuration, and conductive material of the fusible element 32 may all contribute to the rating of the fuse 10. In a preferred embodiment of the invention, fusible element 20 may comprise a length of Wollaston wire.

Terminals 30 and 32 are formed by metallization on the castellations. The metallization may be made by plating, printing, or the like a conductive material (e.g., copper, tin, nickel, or the like) on the castellations. Furthermore, terminals 30 and 32, may be formed by plating, dipping, or the like a conductive material (e.g., copper, tin, nickel, or the like) to partially or substantially fill the castellations. In some examples, the terminals 30 and 32 may be formed prior to singulation to protect the fuse element 20 from being damaged during the singulation process.

Figure 4:
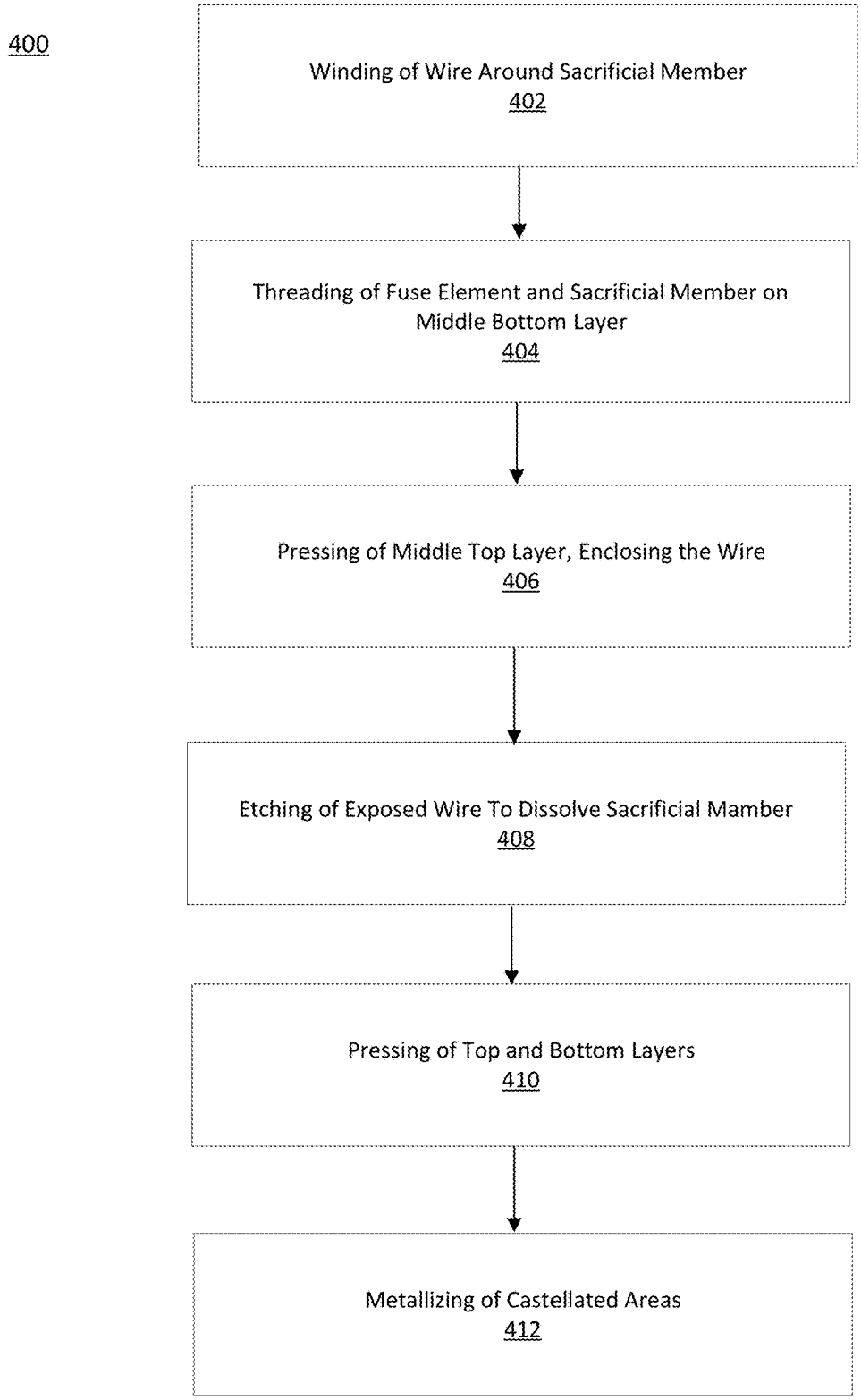
FIG. 4 is a flowchart showing the steps in the manufacturing process used for manufacturing the high breaking capacity few shown in FIGS. 2 and 3.
Figure 5:
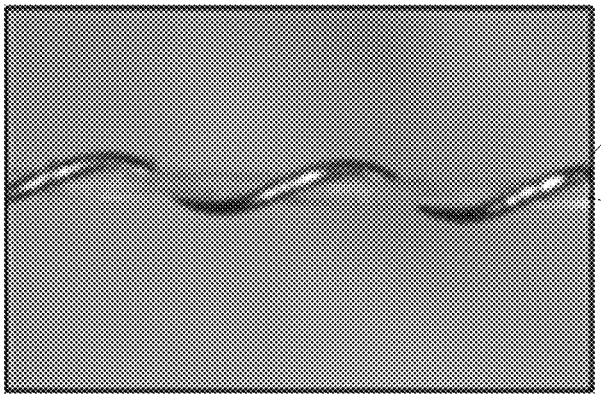
FIG. 5 shows the fuse element wrapped around the sacrificial member, in this case, soluble yarn, prior to threading.
Figure 6:
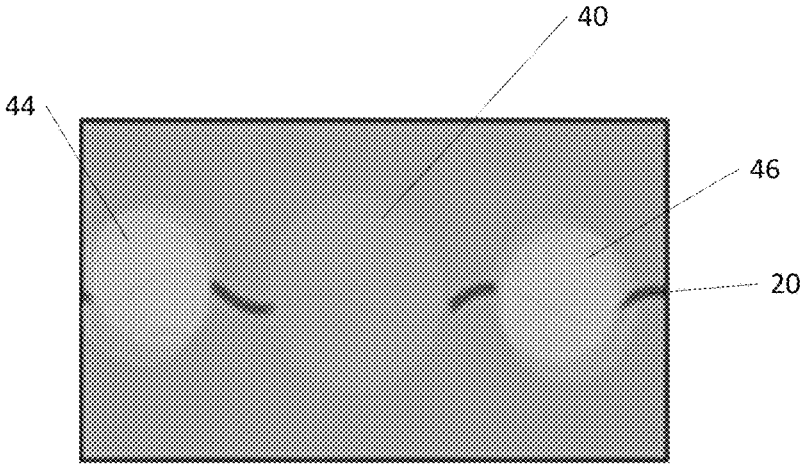
FIG. 6 is an image showing the silver wire jacket of the fuse element exposed within the castellations etched after pressing of the middle layers.
Figure 7:
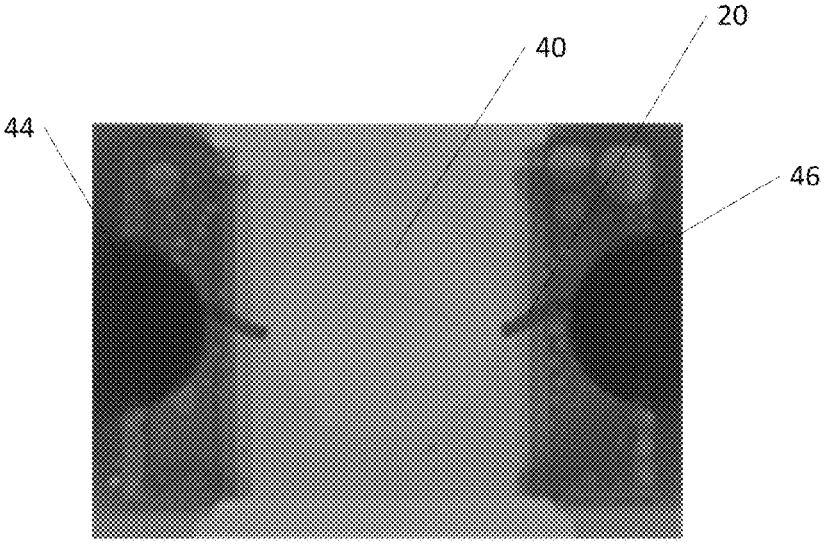
FIG. 7 is an image showing the silver wire jacket of the fuse element selectively etched only in the main cavity of the fuse.
Figure 9:
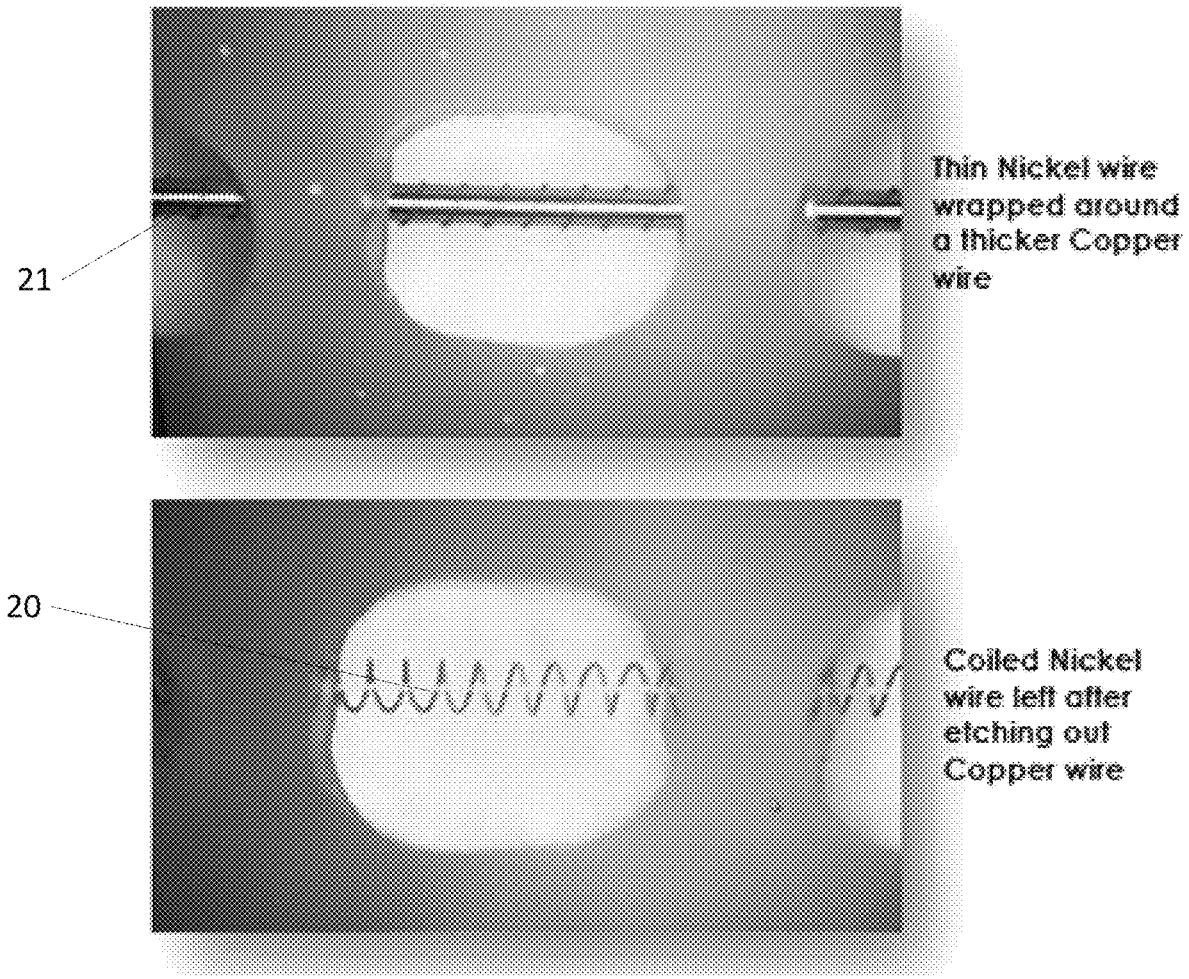
FIG. 9 shows a split body fuse wherein the sacrificial member has the fuse element coiled thereon to support the fuse element during assembly.

FIG. 4 is a flowchart of a process 400 used to manufacture a laminated fuse in accordance with preferred embodiments of the invention. At 402, the fusible element 20 is coiled around a length sacrificial member 21, which may be, for example, soluble yarn, as shown in FIG. 5 or a sacrificial wire, as shown in FIG. 9. At step 404, fusible element 20 and sacrificial member 21 are threaded across middle bottom insulative layer 24 having epoxy sheet 22 disposed thereon. Preferably, fusible element 20 and sacrificial member 21 are disposed intermediate epoxy sheets 18 and 22. Fusible element 20 and sacrificial member 21, having been threaded across middle bottom insulative layer 24, are held in place in anticipation of step 406. At step 406, the middle bottom insulative layer 24 and the middle top insulative layer 16 are laminated together by pressing and heating the assembly until the epoxy sheets therebetween become polymerized. The coiled fusible element 20 and sacrificial member 21 are thereby trapped between middle bottom layer 24 and middle top layer 16. At step 408, the fusible element 20 undergoes etching to remove sacrificial member 21. Additionally, in the case wherein fuse element 20 is a Wollaston wire, the outer silver coating of the wire may also be removed by the etchant, thereby leaving the inner platinum wire exposed and retaining a coiled/slacked form. In a preferred embodiment, the etching occurs both within open cavity 40 and within the castellations located at the edges of the layers. This embodiment is shown in FIG. 6. In an alternate embodiment, only the portion of fusible element 20 located within open cavity 40 is etched; the portion of fusible element 20 located in the castellations is left un-etched. This embodiment is shown in FIG. 7. The process of etching the silver coating from the fusible element 20 also results in the dissolution of the sacrificial member 21 around which the coiled fusible element 20 was wound in step 402. In yet another embodiment wherein the sacrificial member is a non-conducting material, the coiled fusible element 20 may be left completely un-etched, in which case, sacrificial member 21 will remain in place. In preferred embodiments, the etching is accomplished using nitric acid, but other compounds may also be used, depending on the material of which fusible element 20 and sacrificial member 21 are composed. At step 410, top insulative layer 12 and bottom insulative layer 28 are pressed onto the top and bottom of the assembly respectively, and the assembly is heated, thereby sealing open cavity 40. The metallization of the terminals 30 and 32 takes place after the assembly is complete at step 412.

The coiling of the fusible element 20 around sacrificial member 21 serves two purposes. First, sacrificial member 21, as shown in FIG. 5, provides support during the threading process of step 504, described above, to counteract tensile stress induced on fusible element 20 by the threading process. The tensile stress is aggravated by the heating which occurs during the lamination process, because of the difference in the coefficient of thermal expansion of the platinum core of fusible element 20 and the FR-4 material of which the insulative layers 12, 16, 24 and 28 are composed. Second, the coiling of fusible element 20 allows stretching and contraction of fusible element 20 during the assembly process, thereby lessening the chance that the fusible element 20 will suffer a mechanical fracture or a "necking" problem, as shown in FIG. 1, where the fuse element becomes twisted.

Shown in FIG. 9 is an embodiment wherein the sacrificial member 21 is a metal wire having the fusible element 20 coiled therearound. The sacrificial member 21 may be comprised of any metal wire as long as the etching reagent of the sacrificial member 21 does not affect the fuse element 20. In some embodiments, the fuse element may be nickel. In some embodiments, the sacrificial member 21 may be, for example, a copper-zinc alloy or a copper-tin alloy which can be dissolved with the same etchant, silver, which may be etched using nitric acid, zinc, which may be etched using sodium hydroxide or aluminum which may be etched using Keller's etchant.

The use of sacrificial member 21 eliminates the tensile stress placed on fuse element 20 during the placement of the fuse element. It is particularly useful for coiled fuse elements with ultra-fine diameter, for example, less than 30 μm, and provides the opportunity to manufacture ultra-low rating devices without the difficulty of processing fine wires.

Figure 10:
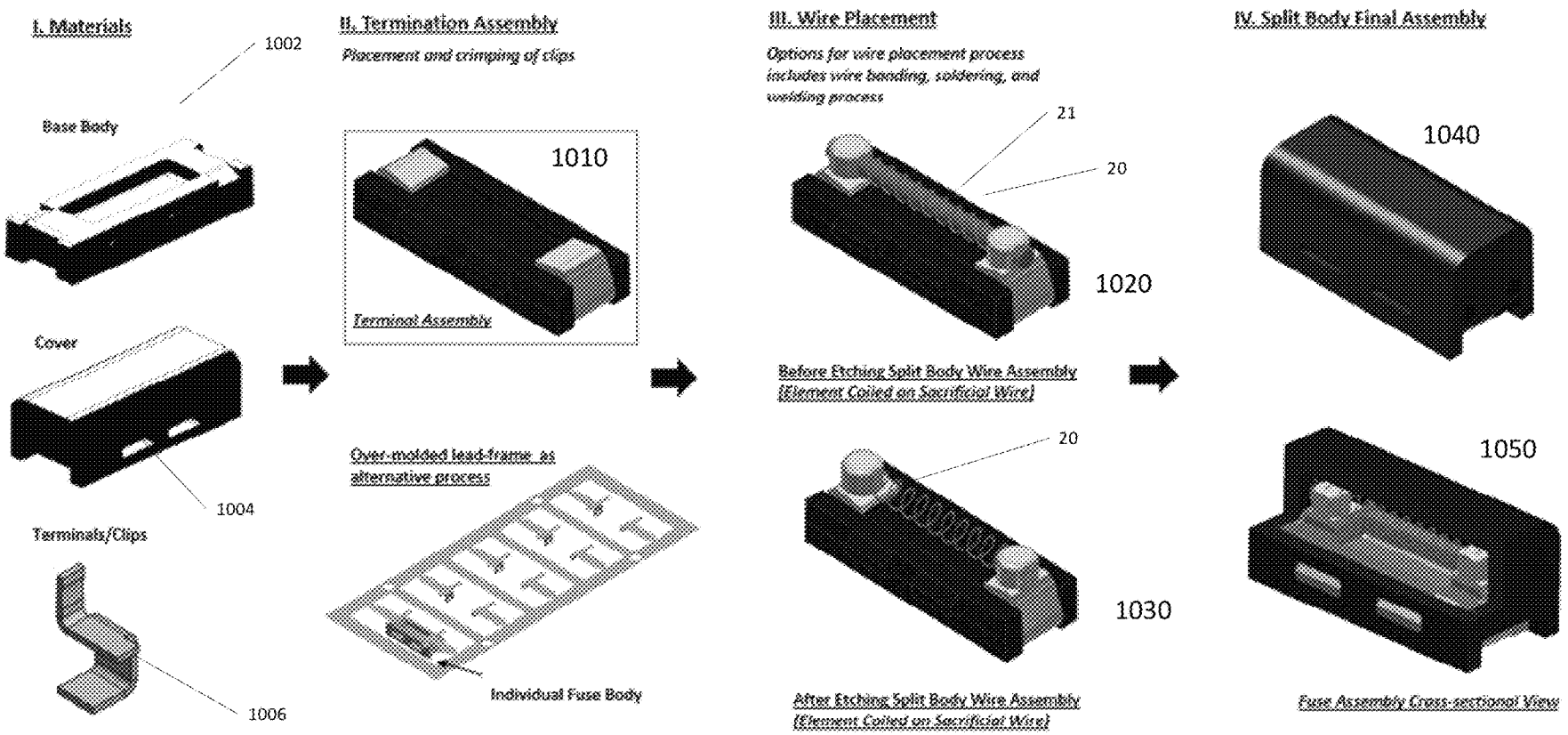
FIG. 10 shows the steps in volved in the manufacture of the split body fuse of FIG.9.

FIG. 10 shows a manufacturing process for a split body type fuse. The body of the split body fuse is comprised of base body 1002 and cover 1004. The terminal assembly 1010 is shown wherein the base body 1002 has terminals or clips 1006 attached thereto. As shown in 1020, in a first embodiment, fuse element 20 is shown coiled around sacrificial member 21 secured between terminals 1006. In 1030, sacrificial member 21 has been etched away, leaving fuse element 20 secured to terminals 1006. The completed fuse 1040 is shown having cover 1004 attached base body 1002. A cross-sectional view of the complete fuse is shown in 1050.

Figure 11:
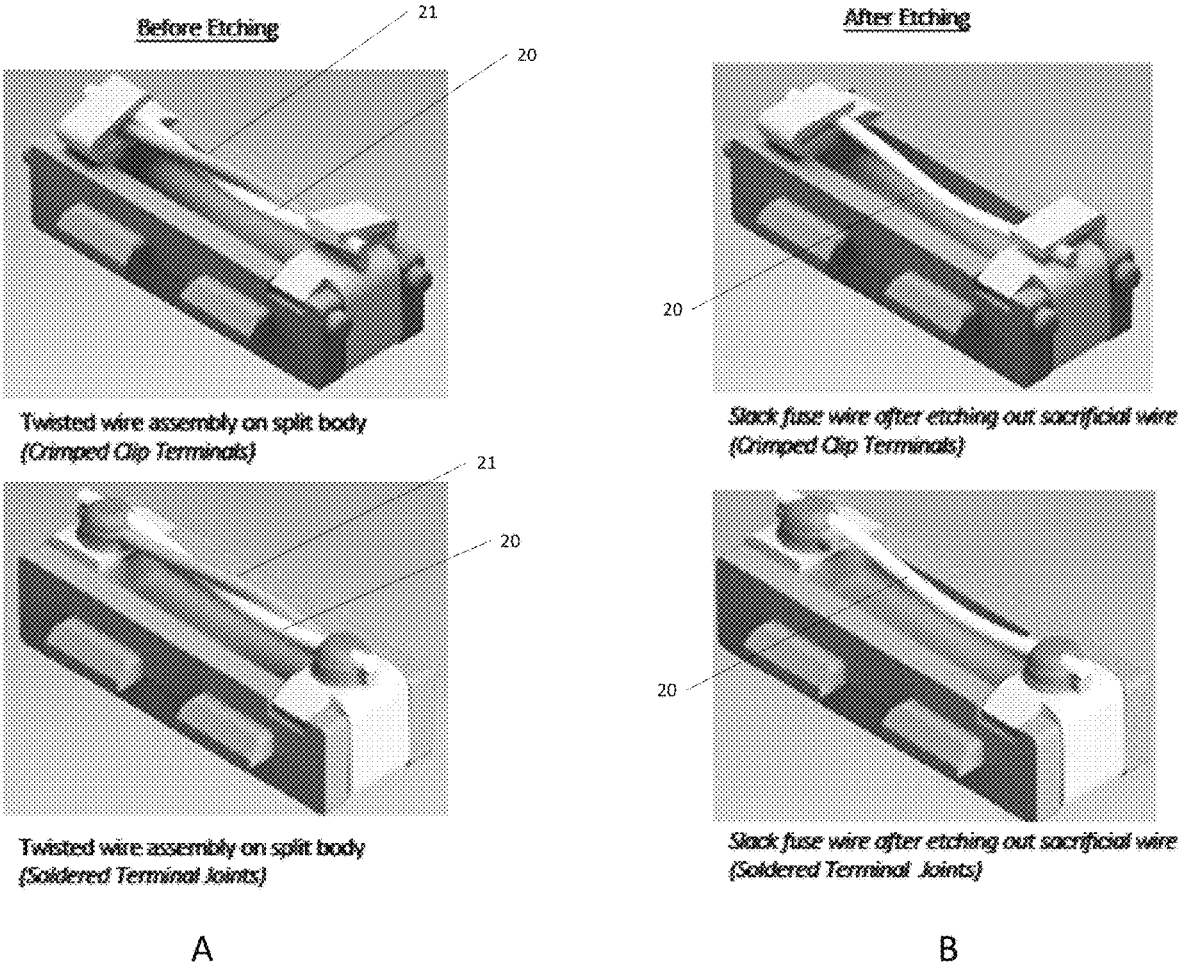
FIG. 11 shows before and after views of a split body fuse wherein the sacrificial member and the fuse element are twisted around each other and secured to the end terminals via crimping or soldering.

FIG. 11 shows a second embodiment of the invention wherein the sacrificial member 21 and the fuse on the 20 are twisted together. FIG. 11A shows both a crimp style terminal and a solder type terminal prior to etching showing both the sacrificial member 21 and the fuse element 20 secured at the ends by the terminals. FIG. 11B shows the remaining fuse element 20 after sacrificial number 21 has been etched away.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed:

1. A method of manufacturing an open-cavity fuse comprising:

providing a first body portion of the open-cavity fuse;

providing a fusible element supported by a sacrificial member, the fusible element and the sacrificial member each being supported at opposite ends thereof by the first body portion and spanning an open cavity defined in the first body portion;

removing the sacrificial member; and providing a top layer disposed on an upper surface of the first body portion and a bottom layer disposed on a lower surface of the first body portion;

wherein the top layer and the bottom layer seal the fusible element within the open cavity; and wherein the sacrificial member is removed prior to sealing the fusible element within the open cavity.

2. The method of claim 1 wherein the fusible element is coiled, braided or twisted around the sacrificial member.

3. The method of claim 2 wherein the sacrificial member is removed by dissolving, etching or ablating.

4. The method of claim 1 wherein the sacrificial member comprises soluble yarn, plastic, polymer, or a metal.

5. The method of claim 1 wherein the open-cavity fuse is a laminated fuse further comprising:

providing a middle bottom layer forming the lower surface of the first body portion and a middle top layer forming the upper surface of the first body portion, the middle bottom layer and middle top layer each being provided with a through-hole formed in a center portion thereof;

threading the fusible element and the sacrificial member across one of the middle bottom layer or the middle top layer such that the fusible element traverses the through-hole defined therein;

laminating the middle bottom layer and the middle top layer to form the first body portion;

laminating the top layer to the middle top layer and the bottom layer to the middle bottom layer.

6. The method of claim 5 wherein the step of laminating the middle bottom layer and the middle top layer comprises:

providing one or more layers of epoxy between the middle bottom layer and the middle top layer; and pressing the middle bottom layer and the middle top layer together and heating until the layer of epoxy therebetween polymerizes.

7. The method of claim 6 wherein:

the step of laminating the top layer to the middle top layer comprises providing a layer of epoxy therebetween, pressing the top layer and the middle top layer together and heating until the layer of epoxy therebetween polymerizes; and the step of laminating the bottom layer to the middle bottom layer comprises providing a layer of epoxy therebetween, pressing the bottom layer and the middle bottom layer together and heating until the layer of epoxy therebetween polymerizes.

8. The method of claim 7 wherein the steps of laminating the top layer to the middle top layer and laminating the bottom layer to the middle bottom layer occur together.

9. The method of claim 5 wherein the top layer, the middle top layer, the middle bottom layer, and the bottom layer comprise a substantially rectangular block of insulative material.

10. The method of claim 9 wherein the insulative material is FR-4.

11. The method of claim 9 wherein the top layer, the middle top layer, the middle bottom layer, and the bottom layer each have a castellation defined on opposite ends thereof.

12. The method of claim 7 wherein the epoxy disposed between the middle top layer and the middle bottom layer is in the form of a sheet having a through-hole formed in a center portion thereof aligning with the through-hole formed in the center portion of the middle top layer and the middle bottom layer, and a castellation defined on opposite ends thereof.

13. The method of claim 5 wherein the through-holes defined in the middle top layer and the middle bottom layer form the open cavity having the fusible element traversing therethrough.

14. The method of claim 11 wherein the fusible element extends outwardly from each end of the middle top layer and the middle bottom layer into the castellation defined on each end of each layer.

15. The method of claim 14 further wherein the fusible element is a Wollaston wire having a platinum core and a silver plating.

16. The method of claim 15 further comprising:

before the top layer is laminated to the middle top layer and the bottom layer is laminated to the middle bottom layer, etching the fusible element within the air gap to remove the silver plating and to dissolve the sacrificial member.

17. The method of claim 16 further comprising:

etching the fusible element extending into the castellation defined on each end of each layer to remove the silver plating and to dissolve the sacrificial member.

18. The method of claim 17 wherein the fusible element is etched using nitric acid.

19. The method of claim 18 further comprising:

metallizing the castellation defined on each end of each layer to form an electrically conductive terminal electrically connected to the fusible element.

20. The method of claim 19 wherein the castellation defined on each end of each layer is metallized by plating or printing with a conductive material.

21. The method of claim 20 wherein the conductive material selected from a group comprising copper, tin and nickel.

22. The method of claim 1 wherein the open-cavity fuse is a split-body fuse the method, further comprising:

attaching terminals at opposite ends of a base body part;

securing each end of the fusible element and sacrificial member to a terminal;

and attaching a cap to the base body part, thereby sealing the open cavity.

23. The method of claim 22 wherein each terminal comprises a crimp type terminal or a solder type terminal.

* * * * *